US008178769B2

(12) United States Patent
Steele

(10) Patent No.: US 8,178,769 B2
(45) Date of Patent: May 15, 2012

(54) UNIVERSAL DRUM PEDAL INSTRUMENT MOUNTING STAND

(76) Inventor: Mark David Steele, New Smyrna Beach, FL (US)

( * ) Notice: Subject to any disclaimer, the term of this patent is extended or adjusted under 35 U.S.C. 154(b) by 0 days.

(21) Appl. No.: 12/803,839

(22) Filed: Jul. 8, 2010

(65) Prior Publication Data

US 2012/0006178 A1 Jan. 12, 2012

(51) Int. Cl.
*G10D 13/02* (2006.01)

(52) U.S. Cl. ..... 84/421

(58) Field of Classification Search ..... 84/421, 84/327, 329

See application file for complete search history.

(56) References Cited

U.S. PATENT DOCUMENTS 6,028,258 A 2/2000 Hicks et al.
6,307,136 B1 10/2001 Sikra et al.
7,071,400 B1 7/2006 Lombardi
7,074,997 B2 7/2006 Steele
7,399,916 B1 7/2008 Lombardi
7,435,888 B2 10/2008 Steele
7,732,692 B2 * 6/2010 Mori et al. ..... 84/421
7,964,781 B1 6/2011 Lovvorn et al.
2006/0207408 A1 9/2006 Steele

* cited by examiner

*Primary Examiner* — Kimberly Lockett

(74) *Attorney, Agent, or Firm* — William C. Schrot; The Auerbach Law Firm, LLC

(57) ABSTRACT

Described herein is a stand for mounting a variety of percussion instruments. These instruments are positioned in a way that allows them to be struck by a drum pedal. The stand has unique adjustment features that allow virtually any mountable percussion instrument to be utilized. The device itself can be mounted in several different ways; on the inside of a bass drum shell or as a free-standing unit. The device can be used as a mount for complete electronic drum pads, or to hold electronic sensors or muffling devices against drum heads.

31 Claims, 19 Drawing Sheets

UNIVERSAL DRUM PEDAL INSTRUMENT MOUNTING STAND

FIELD OF THE INVENTION

This invention relates to percussion instruments and more specifically to the appliances used to mount percussion instruments that are to be struck by bass drum pedals.

BACKGROUND OF THE INVENTION

It is more and more common for drummers to want to use electronic drum triggers for bass drums, usually in search of more foot pedal speed or to electronically change the sound of the drum. Very light beaters change direction more quickly than heavy ones, thus allowing for more speed. Unfortunately, these light, quick bass drum strokes are too soft to be heard if played on a conventional acoustic drum, necessitating the use of electronic triggering and amplification. An extremely small force is required to trigger an electronic pad, which allows drummers to use very light beaters in their pedals with extremely short strokes.

Prior art electronic triggers for bass drum pedals usually come in one of three forms. There is a clip-on device 350 in FIG. 1 that mounts to the rim of a drum 351. Note that a foam cone 352 touches the head of the drum 207, and transfers the vibration from the drum head 207 to the piezo transducer 354. The piezo transducer produces an electrical current when vibrated, and this current is then sent to a drum module for digital sound processing. It is easy to remove this device if need be, however, the triggering performance can be intermittent due to the fact that the piezo transducer 354 is a long way from the point of impact of the drum pedal beater.

Many do-it-yourself drummers have solved this problem by installing a bar (FIG. 2, 281) across the inside of their drums and mounting a home-built piezo and foam apparatus. In this example, the piezo (not shown) is mounted under a foam cone 280, and when the drum head 207 (shown in clear plastic) is struck by the drum pedal 204, the cone 280 transfers the vibration to the piezo transducer. If a drummer has the skills to build one of these, it usually works well but sometimes lacks the dependability of commercial drum pads. Also, adjustments to the device inside a completed drum can be difficult, usually involving hand tools.

A third configuration eliminates the bass drum altogether, and replaces it with a free-standing electronic kick pad as in FIG. 3. These electronic kick pad stands are used in almost all electronic drum sets, and conventional acoustic drum pedals 204 are bolted to the apparatus. They are generally sturdy and the built-in triggering pads 33 have dependable triggering characteristics. The angle and location of the impact pad in relation to the pedal is not adjustable. They are also very expensive, and in many instances, cost more than an entire acoustic drum set.

Note that none of the prior art devices mentioned have the flexibility to mount other percussion instruments, and that the positional adjustability of the electronic triggering devices is limited or non-existent.

My universal drum pedal instrument mounting stand invention is an inexpensive alternative to all prior art, and it allows the drummer to choose from a plethora of readily available electronic pads, acoustic instruments, or dampening devices. These stands can be positioned at the discretion of the musician, and mounted inside or outside of a bass drum.

BRIEF SUMMARY OF THE INVENTION

Described herein is a stand used to mount electronic drum pads or other percussion instruments that are positioned by a drummer to be struck by a bass drum pedal. All of these instruments are mounted on an arm, and my invention has several unique positional adjustment features that let a drummer easily and quickly position instruments in a very precise manner.

The objective of the device is to allow a drummer to position and support virtually all commercially available electronic drum pads or other percussion instruments inside the shell of a bass drum.

Another objective is to allow a drummer to hold a variety of electronic triggering devices against a drum head in a multitude of positions.

A further objective is to allow a drummer to hold a muffling pad against the head of an acoustic drum with adjustable pressure and location.

Yet another objective is to allow a drummer to suspend commercially available drum pads or other percussion instruments in an adjustable position to be struck by a drum pedal on a stand-alone platform.

The concept of mounting an electronic drum pad inside the shell of a bass drum was first described in my Electronic Drum Pedal Patent (U.S. Pat. No. 7,074,997 FIGS. 7, 7a and 8). The universal drum mounting stand was initially included as part of my electronic drum pedal patent (U.S. Pat. No. 7,435,888 B2 FIGS. 18-20a) under dependent claims 18-23.

These and other objectives, as well as a detailed explanation of the invention will be more fully understood from the following specification and drawings in which:

BRIEF DESCRIPTIONS OF THE DRAWINGS

DETAILED DESCRIPTION OF THE INVENTION

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

My universal mounting stands have been designed to work with virtually all mountable electronic or acoustic percussion instruments, are fully adjustable, and will hold them all securely in place. Regardless of whether the stands are mounted on the inside of a bass drum or not, used singly or in pairs, the adjustment capabilities and features remain the same. The function and construction of these stands is described below, and common parts have been given identical numbers.

Figure 4:
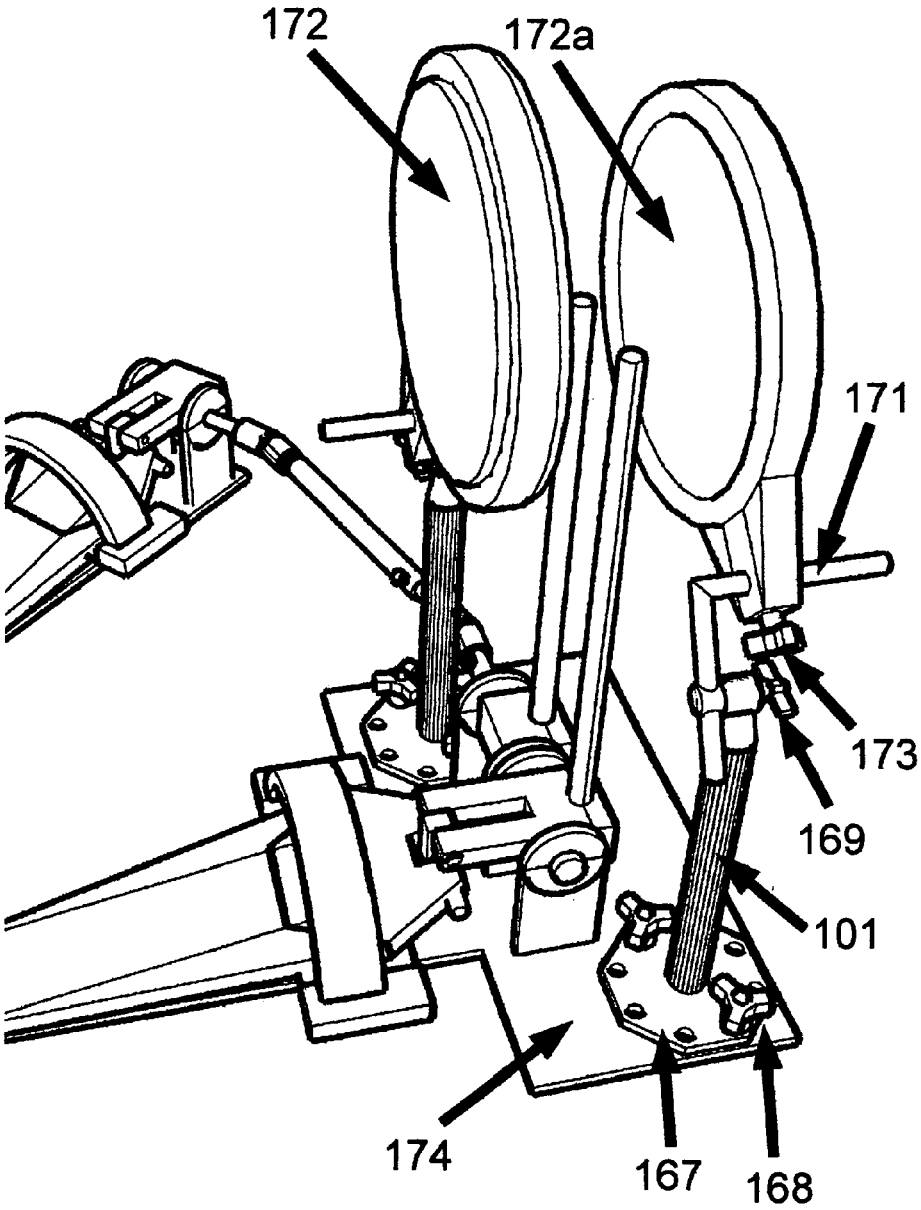
FIG. 4 is a side view of a two-pedal embodiment utilizing two universal mounting stands.

In FIG. 4, the mounting platform is the base of a drum pedal itself 174. Two universal mounting stands have been attached to the base 174 of a previously described two pedal instrument (my U.S. Pat. No. 7,435,888 B2). The downstroke drum pad 172 and the upstroke drum pad 172*a* have identical mounting stands.

The stand base 167 is attached to the drum pedal base 174 using stand base attachment devices, which in this embodiment is a set of bolts and stand base attachment knobs 168. Said stand base has several symmetric mounting holes, enabling the user to rotate and mount the entire assembly to the pedal base 174 according to preference. At the top of the stand body 101 is a rotating clamp assembly 169 used to secure the mounting arm 171. The electronic drum pad 172*a* is attached to the mounting arm 171 by tightening the attachment knob 173 of the drum pad mounting device.

Figure 7:
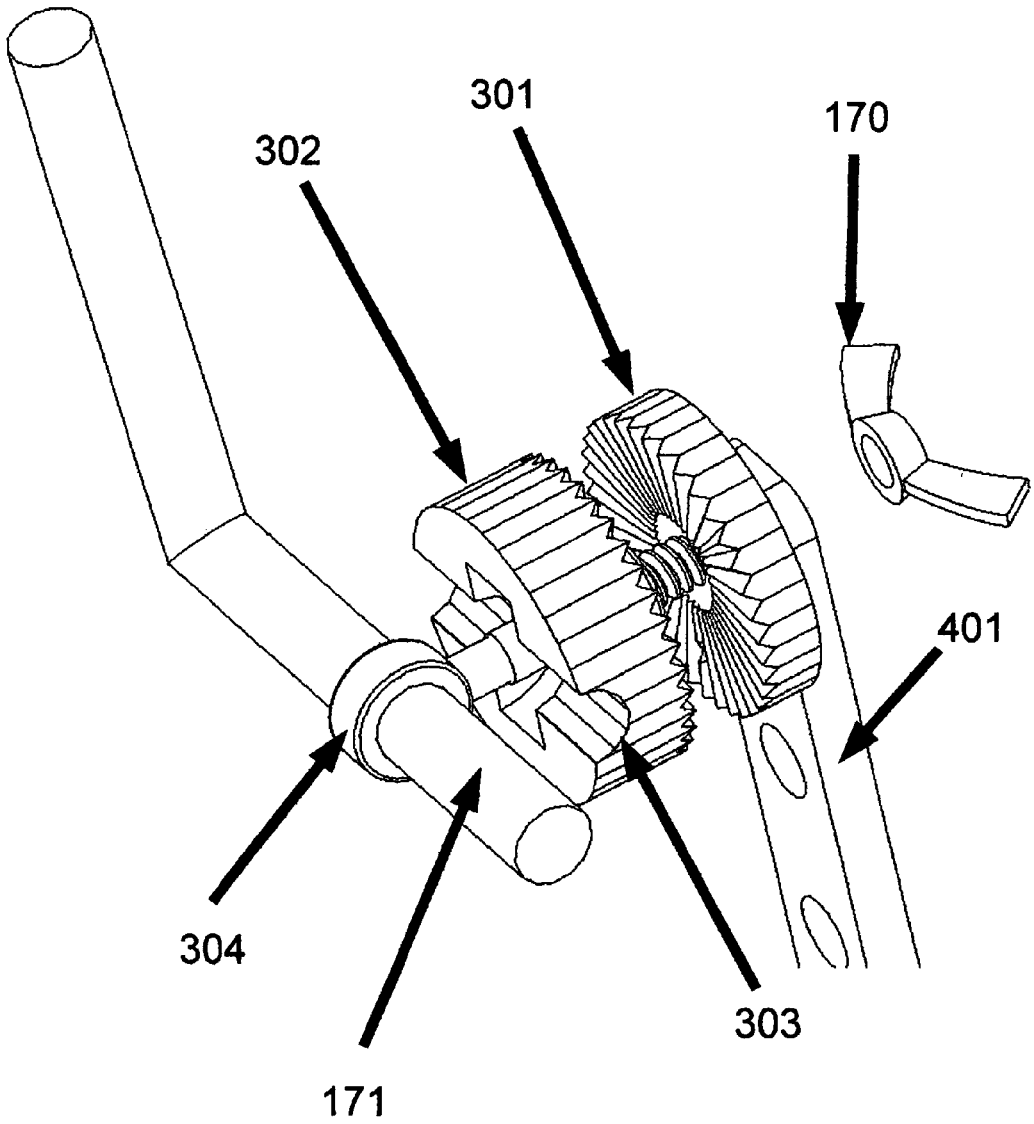
FIG. 7 shows the details of a clamping device in an exploded view.

In FIG. 7, the components of a large rotating clamp assembly are displayed in an exploded presentation. The first portion is a circular ring of teeth 301 which is attached to the upper, distal end of the stand body 401, which in this embodiment is a bar instead of a tube. The second portion is an opposing ring 302 which has a cradle 303 for the mounting arm 171. The mounting arm is held in place in the opening of an eye bolt 304 which goes through both rings (302, 301) and the stand body 401. A clamping nut 170 is tightened on the eye bolt 304 which locks all parts together. When the clamping nut 170 is loosened, the mounting arm 171 can adjustably rotate 360 degrees or slide longitudinally in the cradle 303 of the opposing ring 302, and this entire assembly (mounting arm, eye bolt and cradle) can pivot 360 degrees relative to the stand body 401, around the axis of the eye bolt 304, then be positioned securely by tightening the clamping nut 170. Note that the mounting arm 171 is preferably bent at a 90 degree angle.

Figure 4A:
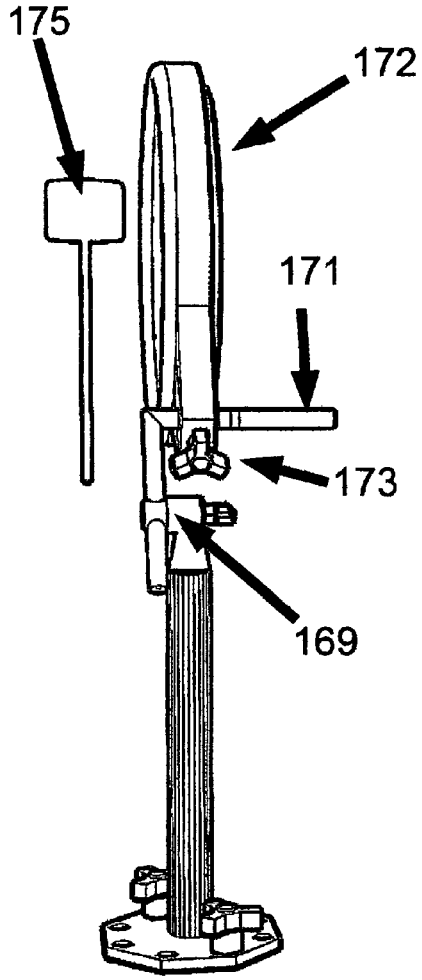
FIGS. 4A and 4B are side views showing how a drum pad can be adjustably placed using a universal mounting stand.
Figure 4B:
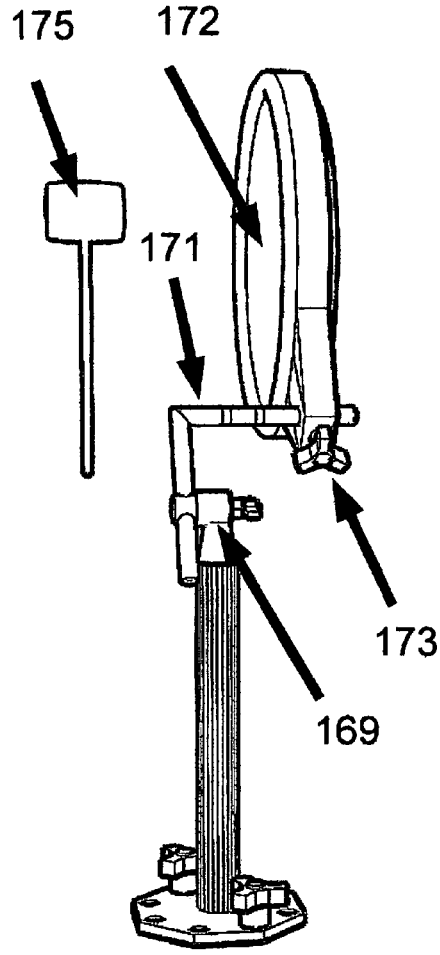

FIGS. 4A and 4B show how the distance is varied between the striking device 175 in the at-rest position and the drum pad 172. After all adjustments to the arm clamping device 169 have been made, the drum pad 172 is positioned on the mounting arm 171 as desired and set in place using the drum pad mounting device knob 173.

Figure 5:
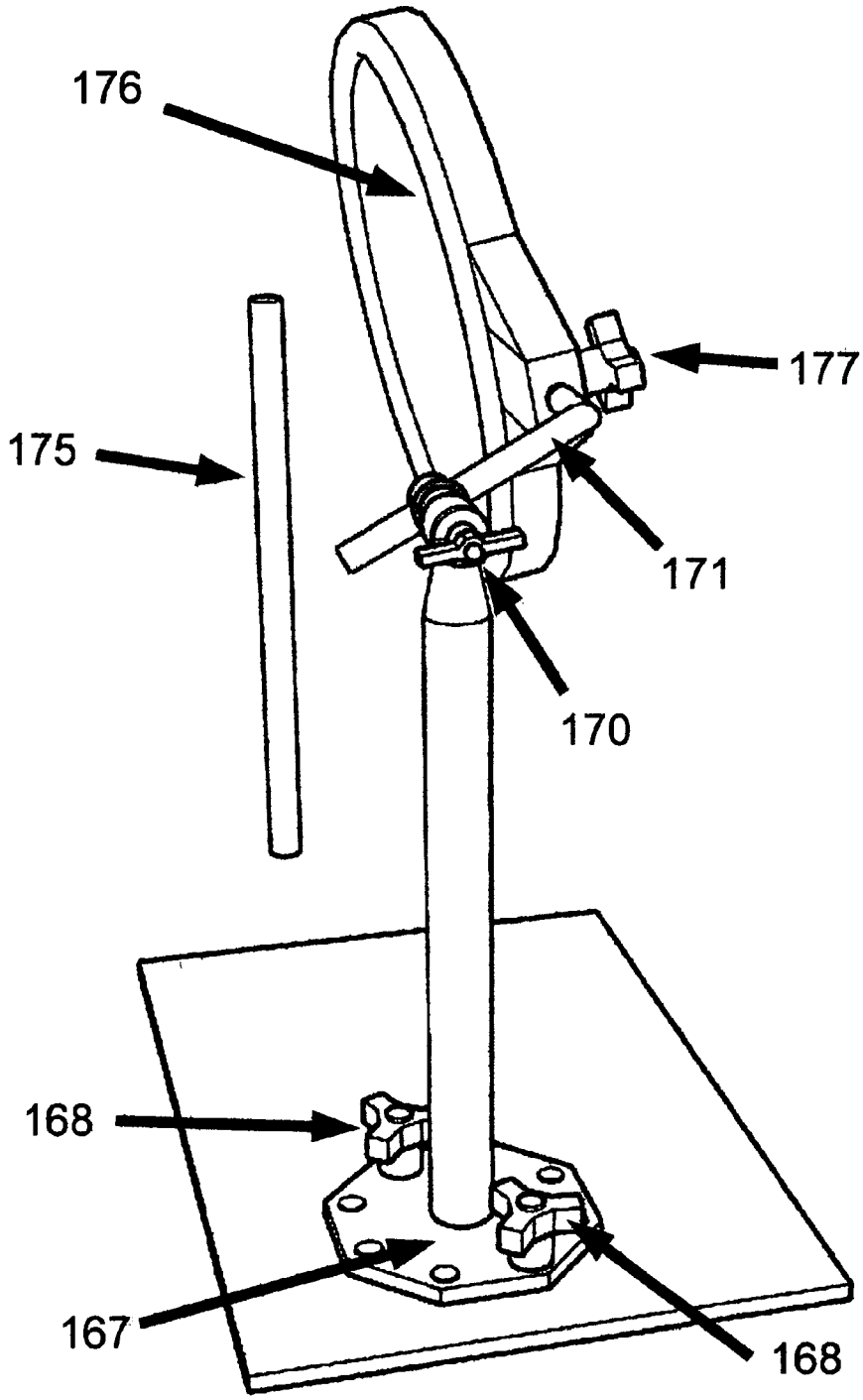
FIG. 5 shows another type of electronic drum pad held in position by a universal mounting stand.
Figure 5A:
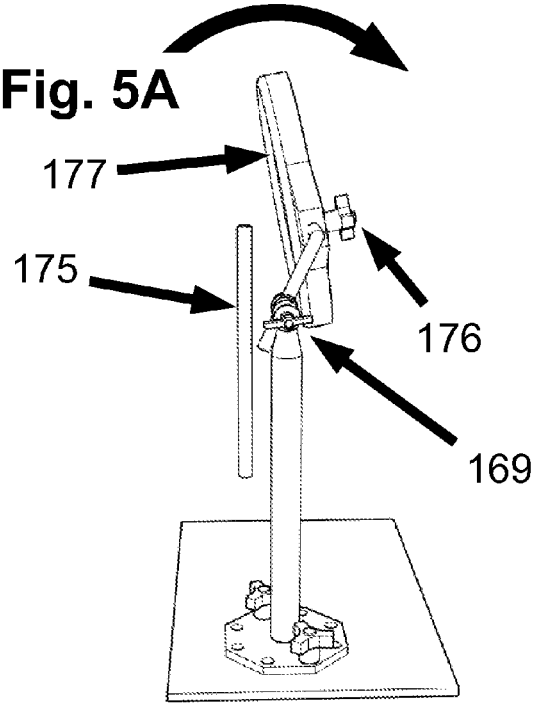
FIGS. 5A, 5B, 5C and 5D show how an electronic drum pad can be positioned using a universal mounting stand.
Figure 5B:
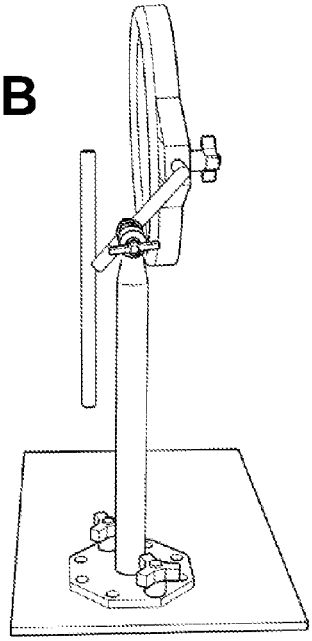
Figure 5C:
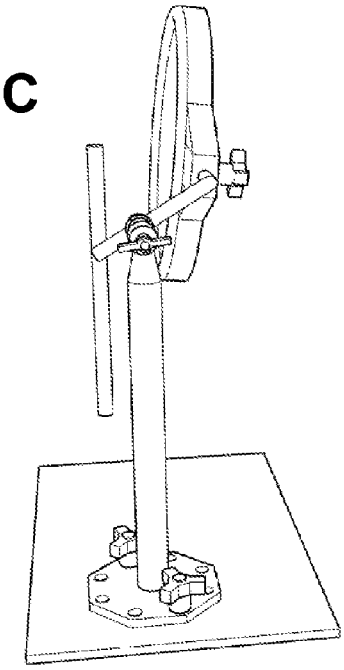
Figure 5D:
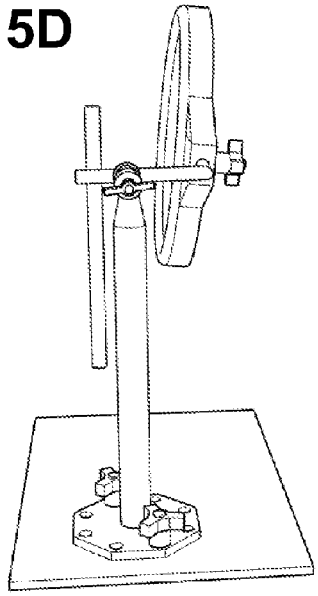

Note that the electronic drum pad 172 in FIGS. 4 and 4A is constructed such that the mounting arm 171 goes through the drum pad perpendicular to the striking surface of the drum pad, and that the mounting arm needs to be generally horizontal. Unfortunately, many commercially available electronic drum pads have a different mounting system; the mounting arm is inserted directly into the tail end of the drum pad parallel to the striking surface. FIG. 5 shows such a pad which is mounted to my universal mounting stand.

Note that the entire mounting stand in FIG. 5 has been rotated 90 degrees as compared to FIG. 4; the arm clamping device adjustment knob 170 now faces the reader. This is accomplished by removing the stand base attachment knobs 168, rotating the entire assembly as desired and re-attaching said knobs. With this style of pad, the drum pad mounting arm 171 needs to be positioned in the arm clamping device 169 so that the mounting arm can be inserted directly into the bottom of the drum pad 176 and fastened using the drum pad mounting device knob 177.

FIGS. 5A, 5B, 5C and 5D show how the drum pad 177 can be positioned in relation to the striking device 175. The arm clamping device 169 can be adjusted so that said drum pad moves in an arc away from or towards said striking sticks.

Figure 6A:
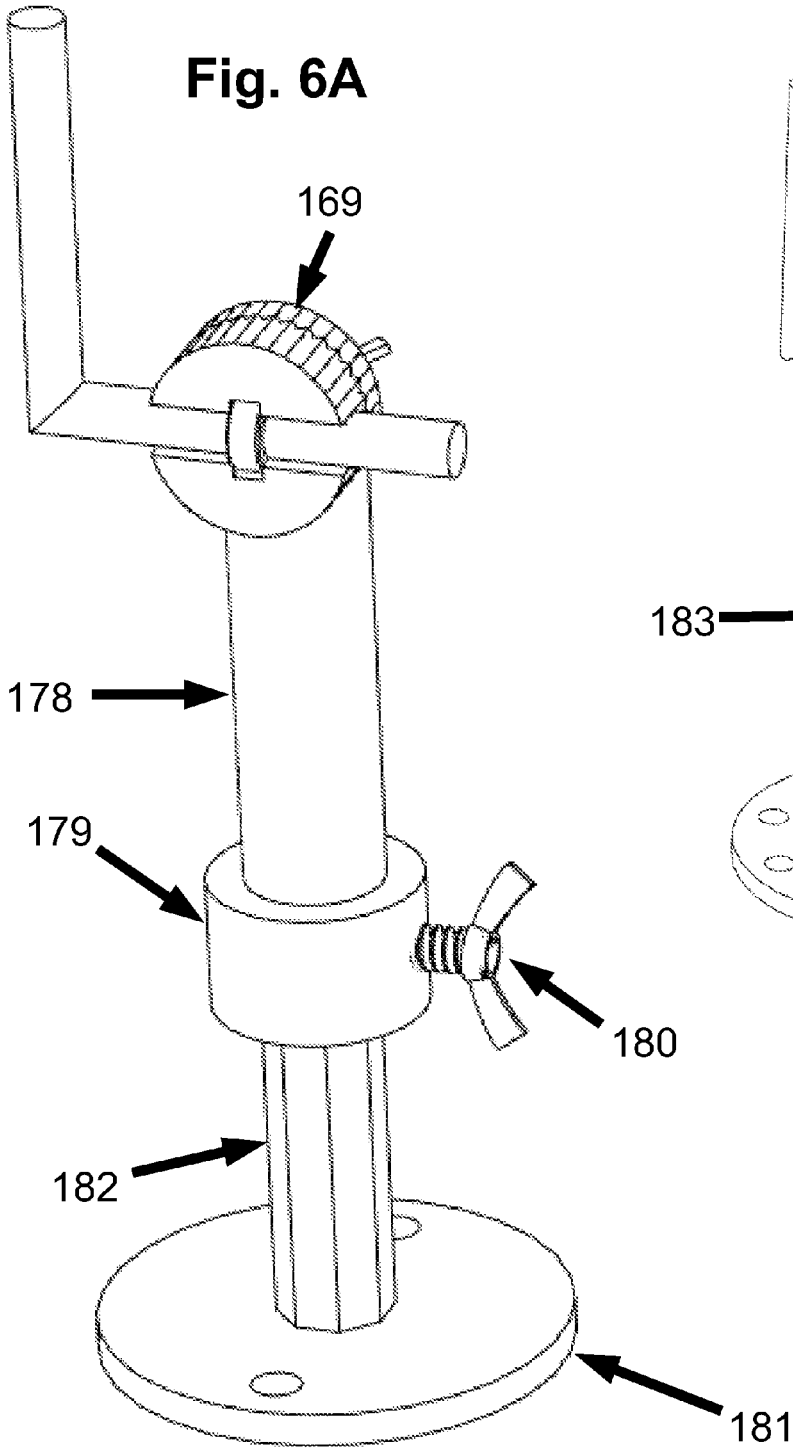
FIG. 6A depicts a universal mounting stand with a telescoping stand body.
Figure 6B:
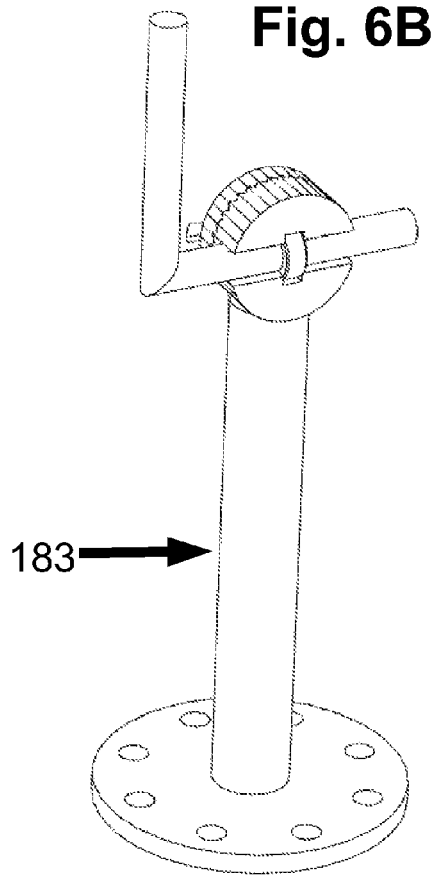
FIG. 6B shows a solid tube universal mounting stand for comparison purposes.

FIG. 6A depicts another embodiment of the universal instrument mounting stand, next to a previously disclosed mounting stand 183 in FIG. 6B. Note that the stand body in FIG. 6A has been broken into two parts; a lower tube part 182 and an upper tube part 178. The two tube parts telescope into each other. The lower tube part can be directly attached to a mounting platform, or an optional mounting flange 181 can be used as shown. The upper tube part has an arm clamping device attached to the upper distal end, which in this embodiment is a rotating clamp assembly 169. The upper tube part 178 has a tube clamp 179 and a tube clamp tightening knob 180. The height of the assembly can be varied by loosening said knob and raising or lowering the upper tube part, then tightening said knob. The upper tube part can also be rotated around the lower tube part before tightening, allowing the drummer to change the orientation of the arm clamping device 169 and arm as desired.

Figure 7A:
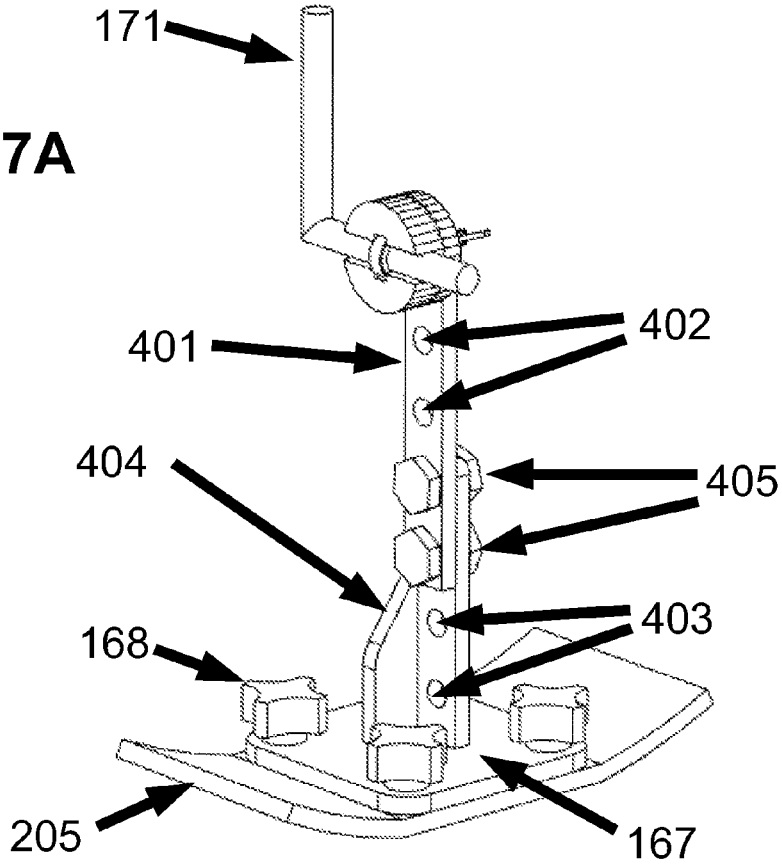
FIG. 7A shows details of a universal mounting stand that has been adjusted to accept an instrument requiring a vertical mounting arm.
Figure 7B:
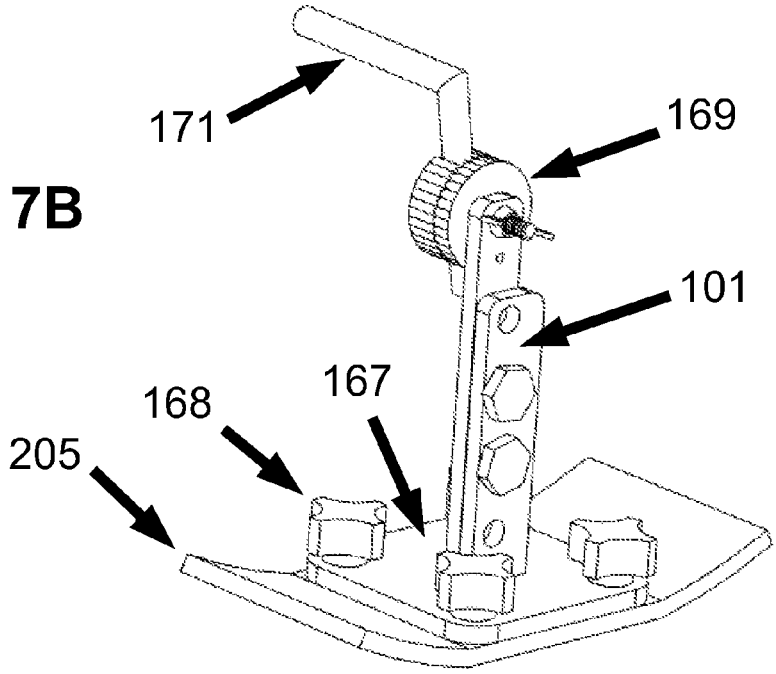
FIG. 7B shows details of a universal mounting stand that has been adjusted to accept an instrument requiring a horizontal mounting arm.

In FIGS. 7A and 7B I have presented other methods for adjusting the position of the mounting arm. In this embodiment, the mounting platform is a bracket 205 that will attach to the inside of a bass drum. Note that the stand body 101 is comprised of two parts, and that the upper stand body bracket 401 has several mounting holes 402. These holes will mate with similarly spaced holes 403 on the lower stand body bracket 404. The height will vary depending upon the holes chosen for the stand body assembly bolts 405. Note that the lower stand body bracket 404 is permanently attached to a stand base 167 that has symmetrical holes that align with bolts in the mounting platform 205. These holes allow the entire stand to adjustably rotate on an axis perpendicular to the mounting platform, then be fixed in place using finger nuts 168. In this four-hole embodiment, the symmetrical hole pattern allows the entire assembly to be attached to the mounting platform 205 in 4 ways, in increments of 90 degrees, depending upon the type of pad or instrument that is to be mounted on the mounting arm 171. Note that if the stand base had eight symmetric holes as in FIG. 6B, the stand base could be attached in increments of 45 degrees. Twelve holes would allow mounting in increments of 30 degrees etc.

FIG. 7A shows a universal mounting stand at full height, and the mounting arm 171 is set for a drum pad that requires a vertical mounting arm. In FIG. 7B, the stand body 101 has been fully lowered, the stand base 167 has been rotated 90 degrees and secured to the mounting platform 205 with stand base attachment knobs 168, the arm clamping device 169 has been rotated 90 degrees, and the mounting arm 171 has also been rotated 90 degrees and set for the appropriate height in the cradle of the arm clamping device 169. The apparatus is now ready to accept an instrument that requires a horizontal mounting arm. Note that the mounting arm can be rotated in the cradle of the arm clamping device 169 in an arc of 360 degrees, the cradle of the arm clamping device can rotate a full 360 degrees relative to the stand body, and that the entire stand can be rotated 360 degrees and bolted to the mounting platform.

Figure 8:
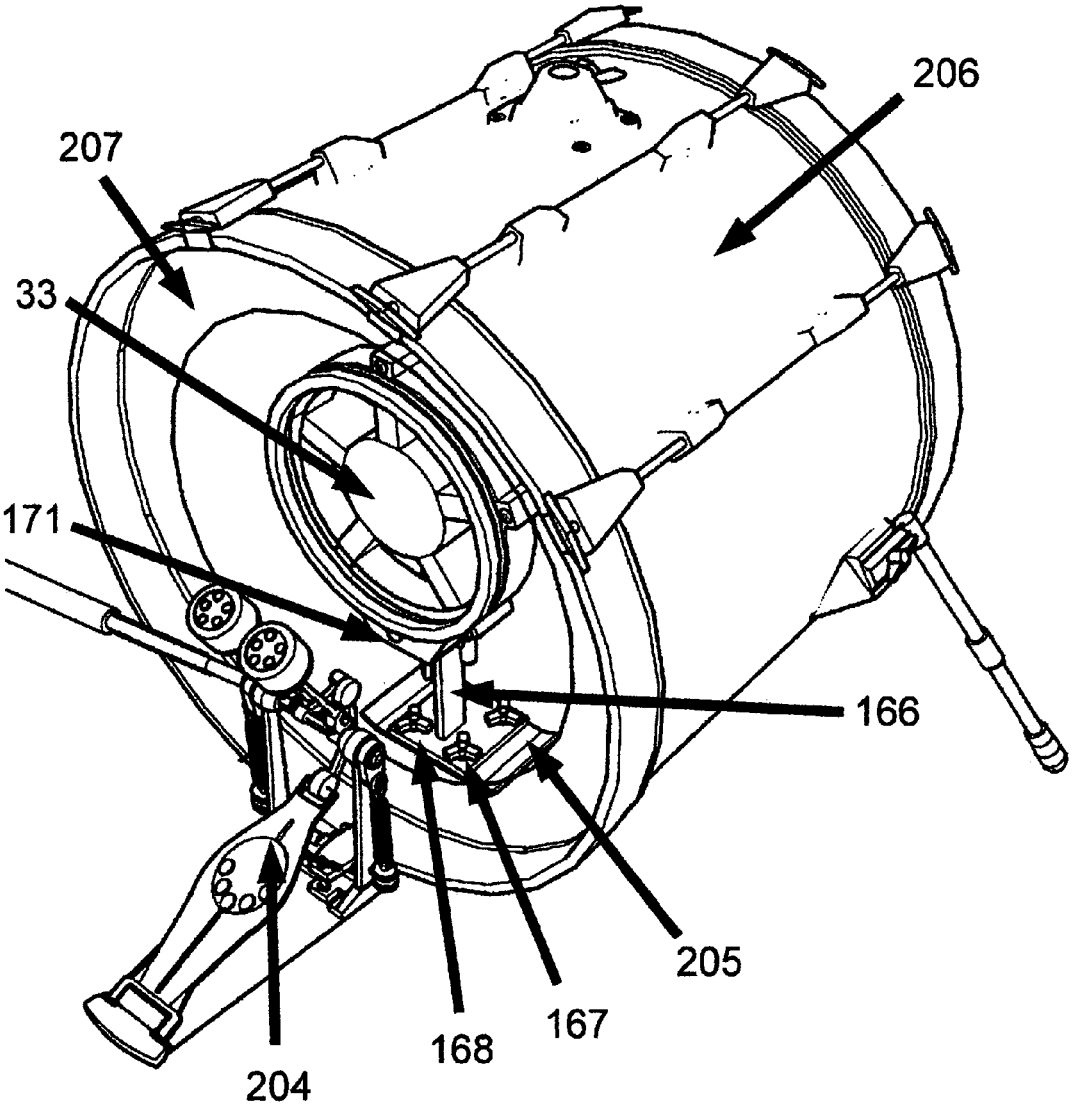
FIG. 8 depicts the universal mounting stand and a commercial drum pad used inside a bass drum.

FIG. 8 depicts a universal mounting stand 166 mounted on the inside of a bass drum 206, using a commercial drum pad 33. Note that most of the rear drum head 207 has been cut away so that the drum pedal beaters can strike the electronic pad directly. The mounting platform 205 in this embodiment is a bracket attached to the inside of a bass drum. The stand base of the universal mounting stand 167 bolts onto the mounting platform 205 using finger nuts 168. Note that the stand base 167 can be rotated as desired before attaching it to the mounting platform, and the drum pad can be positioned inside the drum as previously described.

Figure 9A:
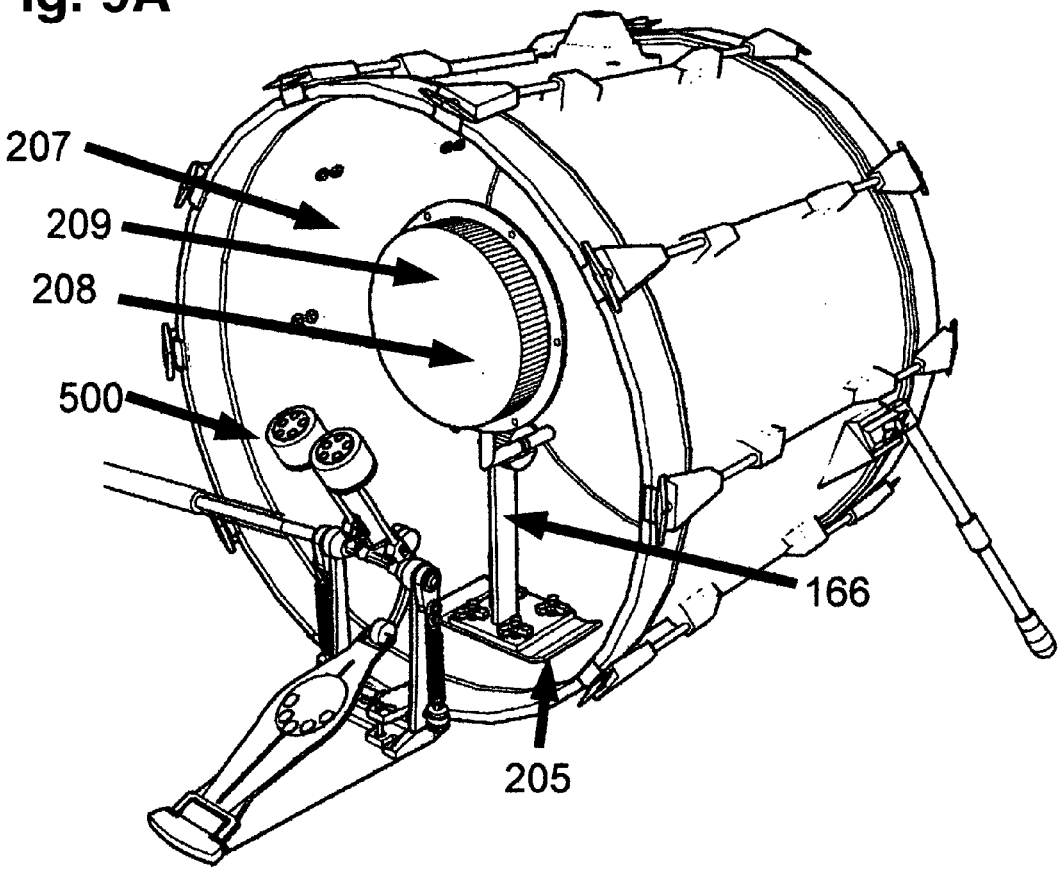
FIG. 9A shows an electronic pad resting on a drum head supported by a universal mounting stand.

In FIG. 9A, the drum head 207 remains intact. It can be a mesh head (used for silent playing) or a normal acoustic drum head, shown here in transparent plastic. The mounting platform 205 is mounted to the shell of the drum as described in FIG. 8, but instead of using a complete electronic drum pad (with a head), a foam pad 208 with embedded triggers (piezo transducers) 209 is used.

Note that in FIG. 9A the drum beaters 500 strike the drum head 207 with the foam pad directly in line with the stroke impact. For drummers that want a natural drum sound in addition to electronic triggering, this severe muffling effect may be undesirable. Also, striking the triggers directly may cause an overly sensitive response from the triggers.

Figure 9B:
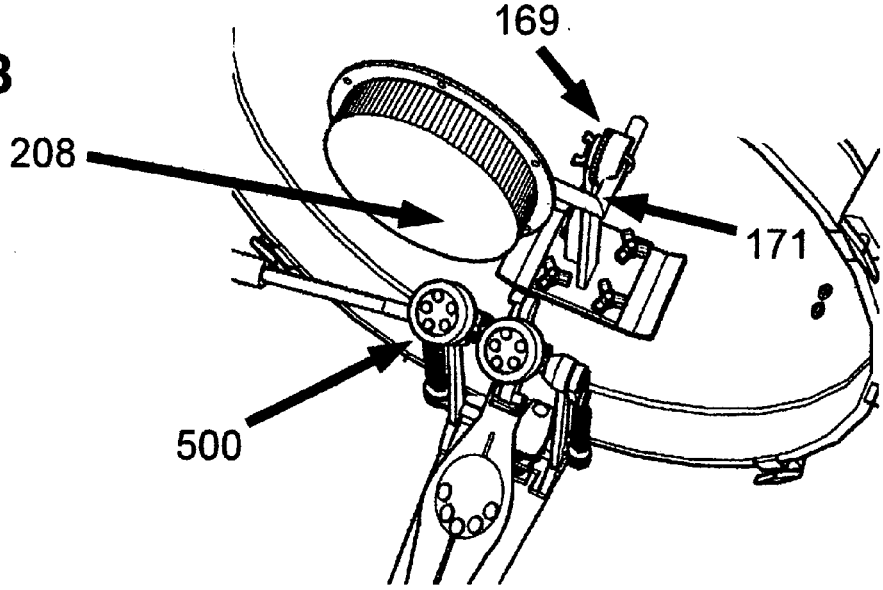
FIG. 9B shows the same pad rotated to a different place inside the bass drum.

FIG. 9B shows how these problems can be solved by my device. The universal mounting stand arm clamping device 169 has been adjusted to allow the drum pad 208 to be rotated to a location away from the area where the beaters 500 impact the drum head 207. The amount of muffling and the electronic pad sensitivity can therefore be adjusted easily by the drummer.

Figure 1:
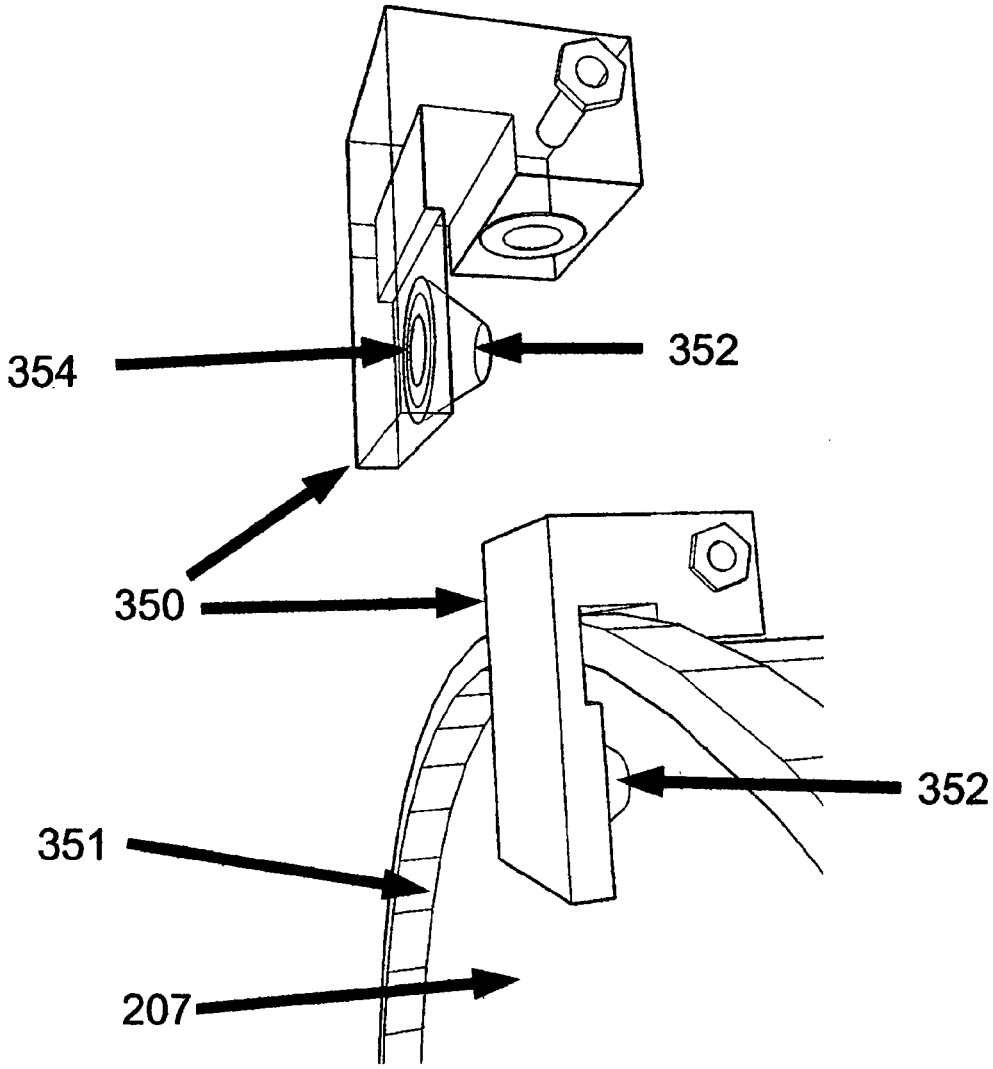
FIG. 1 shows a prior-art clip-on drum trigger assembly, with a transparent view.
Figure 2:
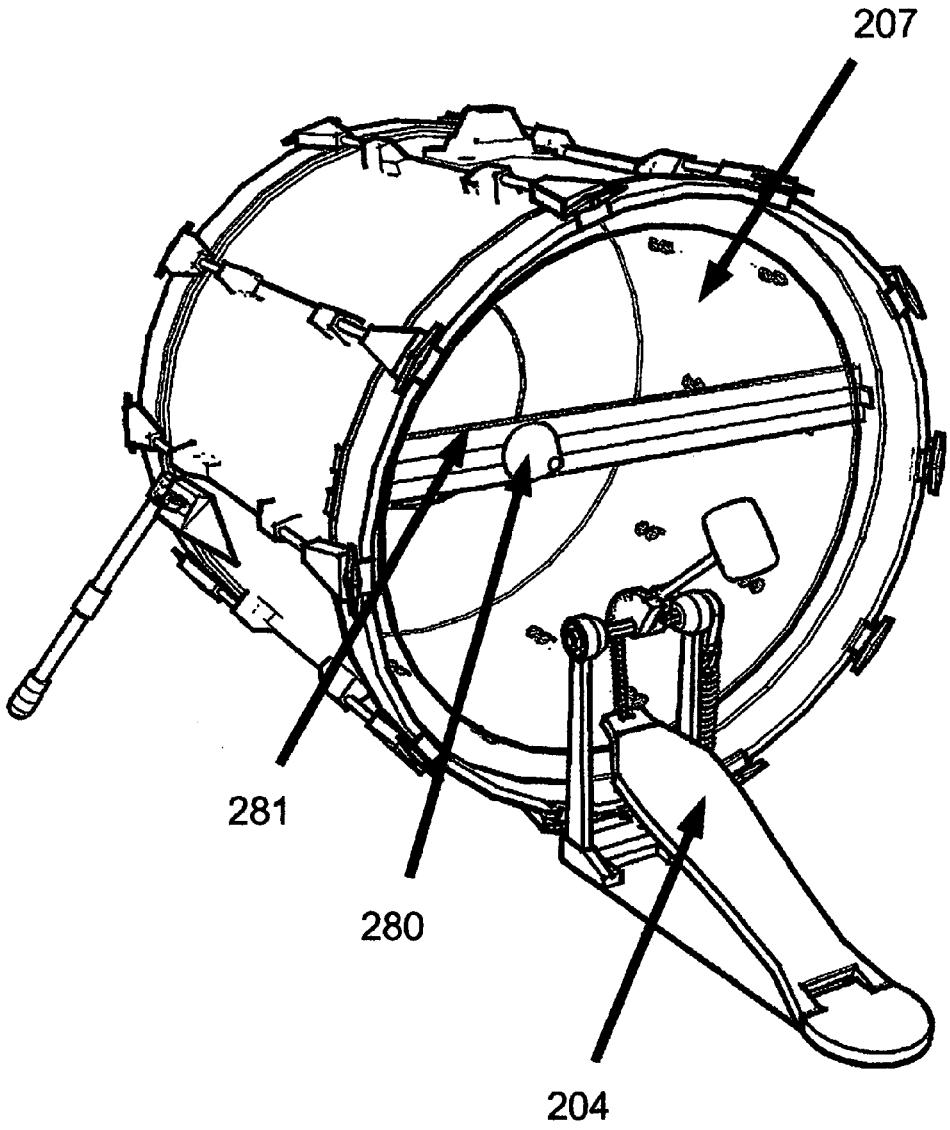
FIG. 2 depicts a home-made piezo support bar.
Figure 3:
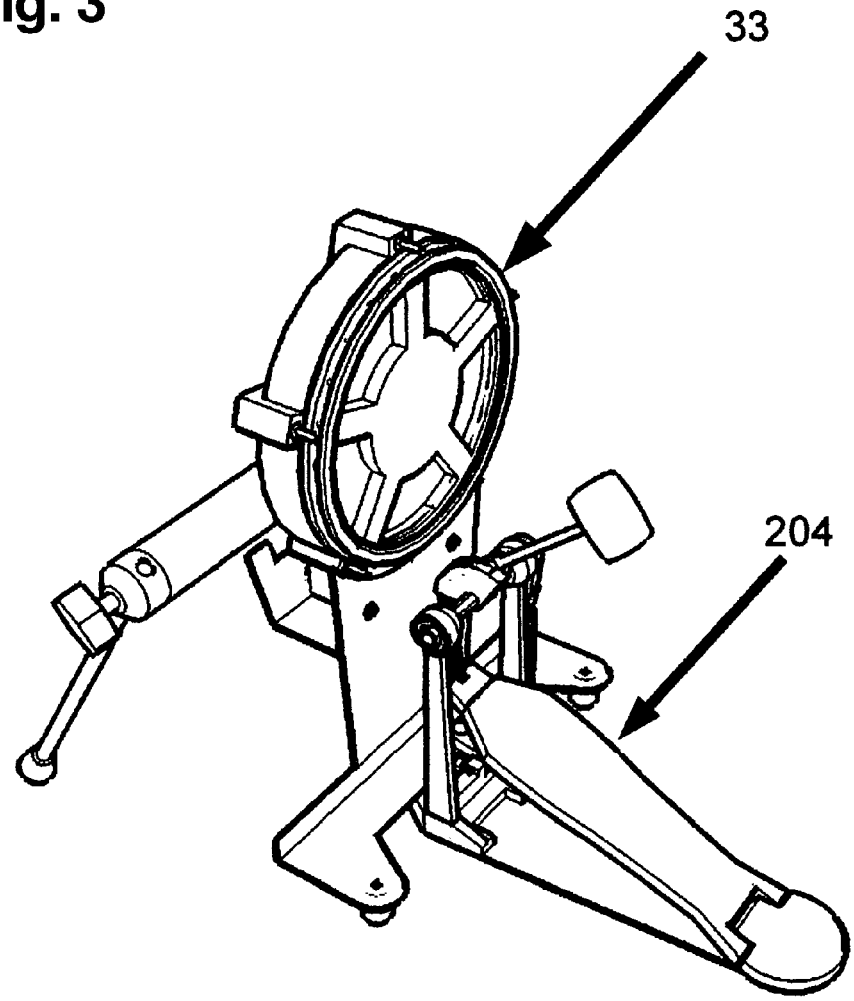
FIG. 3 shows a prior art stand-alone electronic kick pad assembly.
Figure 10A:
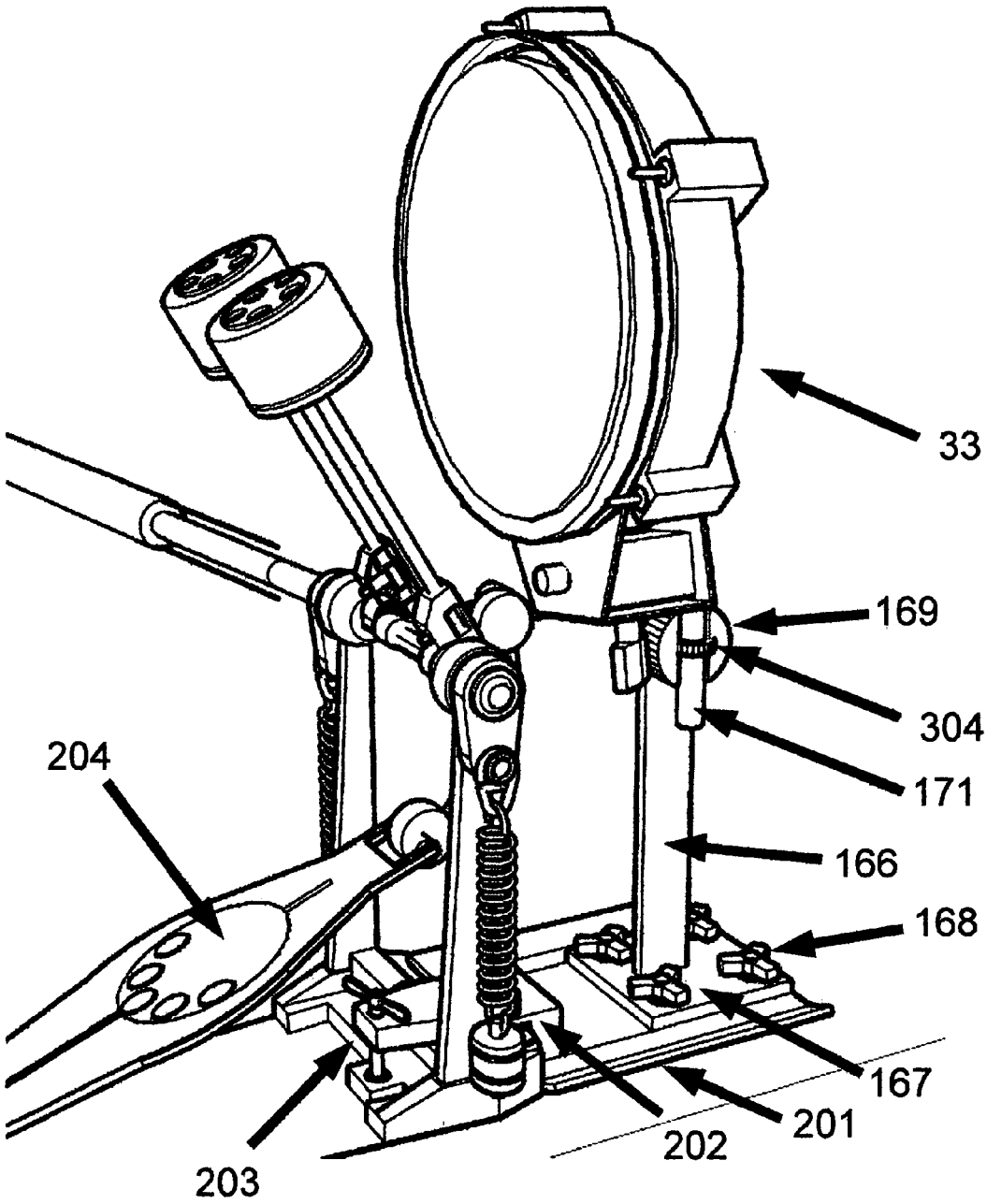
FIG. 10A shows an electronic drum pad mounted to a universal mounting stand attached to a floor plate outside of a bass drum.

My invention is also useful outside of bass drums. In FIG. 10A, a floor plate 201 is used as a mounting platform. An electronic drum pad 33 has been attached to the mounting arm 171 of the universal mounting stand 166. The base of the stand 167 has been attached to the floor plate 201 using finger nuts 168. The drum pedal clamp 203 is used to attach the drum pedal 204 directly to the mounting dock 202 of the floor plate. The rotating assembly arm clamping device 169 utilizes eve bolt 304 as previously described. Note that the universal mounting stand can be adjusted to support any type of electronic drum pad, and that the position of the pad is fully adjustable, unlike the more expensive example in FIG. 3.

Figure 10B:
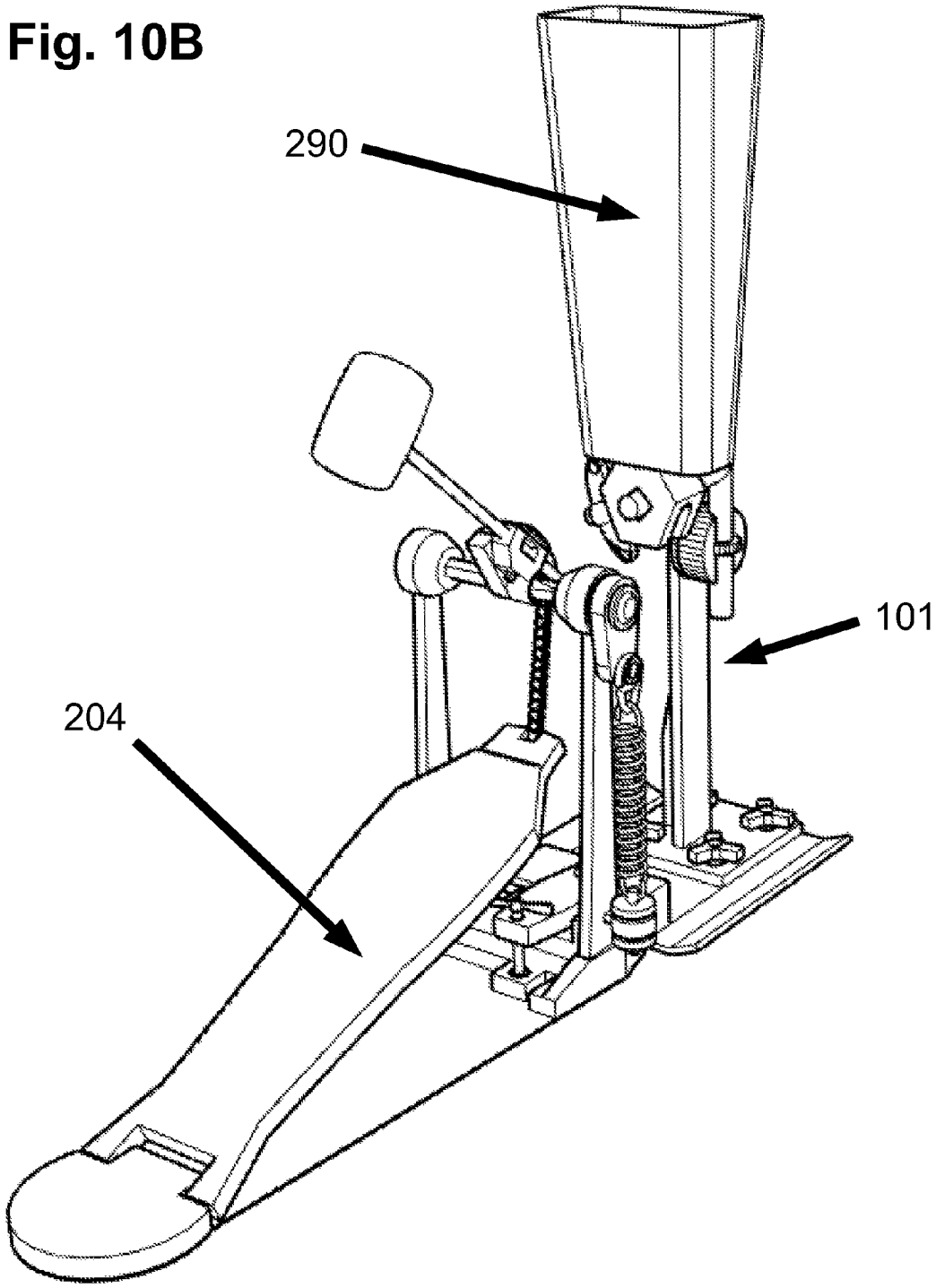
FIG. 10B shows a cow bell mounted to a universal mounting stand attached to a floor plate.

In FIG. 10B, a cowbell 290 has been mounted to my invention. The ability to rotate the entire bracket on the stand base along with an adjustable arm clamping device allows for a wide variety of drums, bells, blocks and other mountable instruments to be used with one versatile stand, regardless of the positional requirements of the mounting arm. Note that the stand body 101 in this embodiment is a length of angle iron.

Figure 11A:
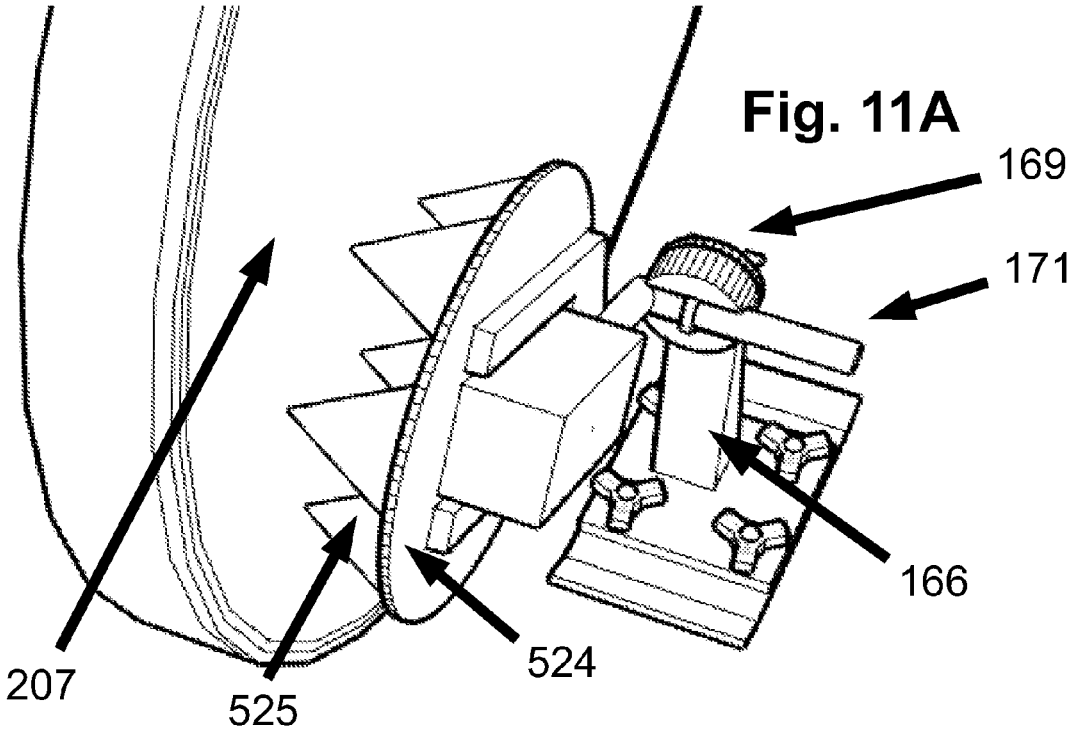
FIGS. 11A, 11B, 11C and 11D depict a drum muffle pad mounted to the universal mounting stand inside a bass drum in a variety of positions and pressures against an acoustic bass drum head.

My invention is also useful in precisely muffling acoustic bass drums. In FIG. 11A, a universal mounting stand 166 has been mounted inside an acoustic bass drum, near the drum head 207 (the shell of the drum has been removed for clarity). A drum pedal (not shown) will strike the opposite side of the drum head 207. A muffling pad 524 has been mounted on the arm 171 of the universal stand. In this embodiment, the muffling pad is comprised of an array of foam cones 525. The arm clamping device 169 has been has adjusted so that the tips of the foam cones 525 are not touching the drum head 207, allowing the head to ring freely when struck from the other side by a drum pedal.

Figure 11B:
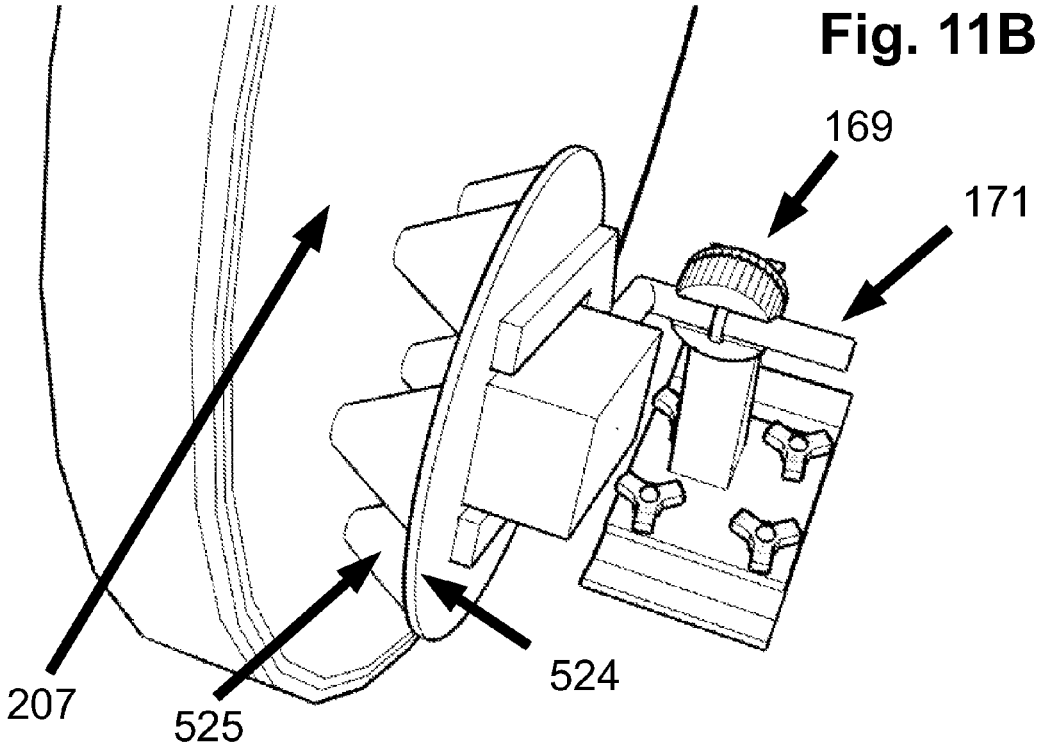

In FIG. 11B, the arm clamping device 169 has been adjusted so that the tips of the foam cones 525 are touching the drum head very lightly, in order to slightly muffle the head as if fingertips were gently pressing on the head. This muffling pad 524 can be swung to a plethora of positions on the head to produce the exact tone desired by the drummer.

Figure 11C:
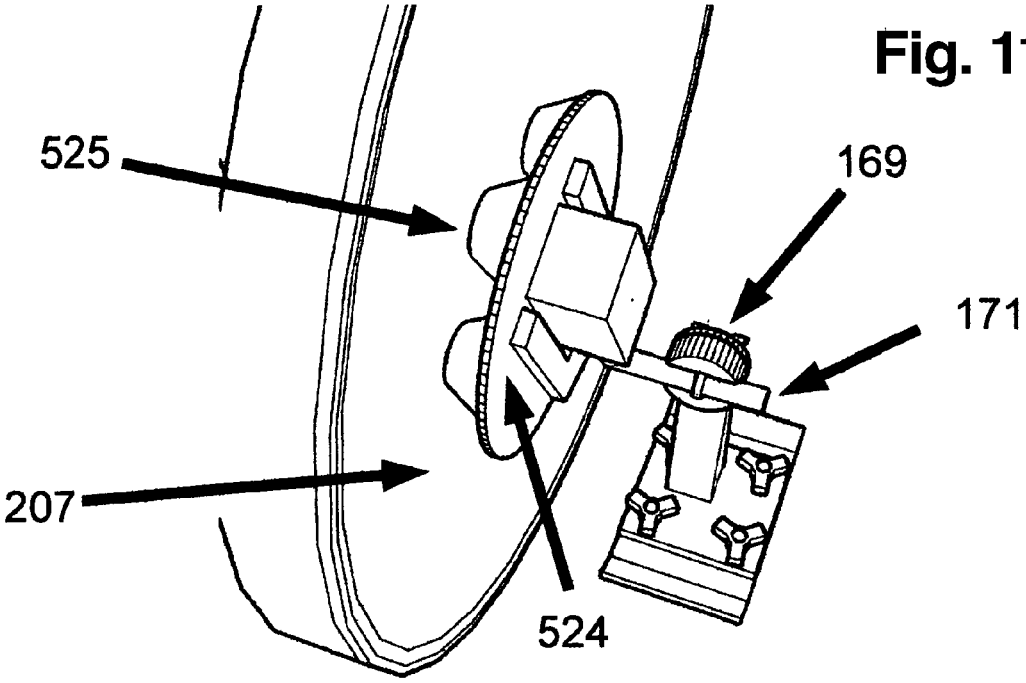

In FIG. 11C, the arm clamping device 169 has been adjusted so that the muffling pad 524 has been moved closer to the drum head 207 and the foam cones 525 are halfway flattened. Also, the pad has been swung closer to the point of impact, increasing the deadening of the drum.

Figure 11D:
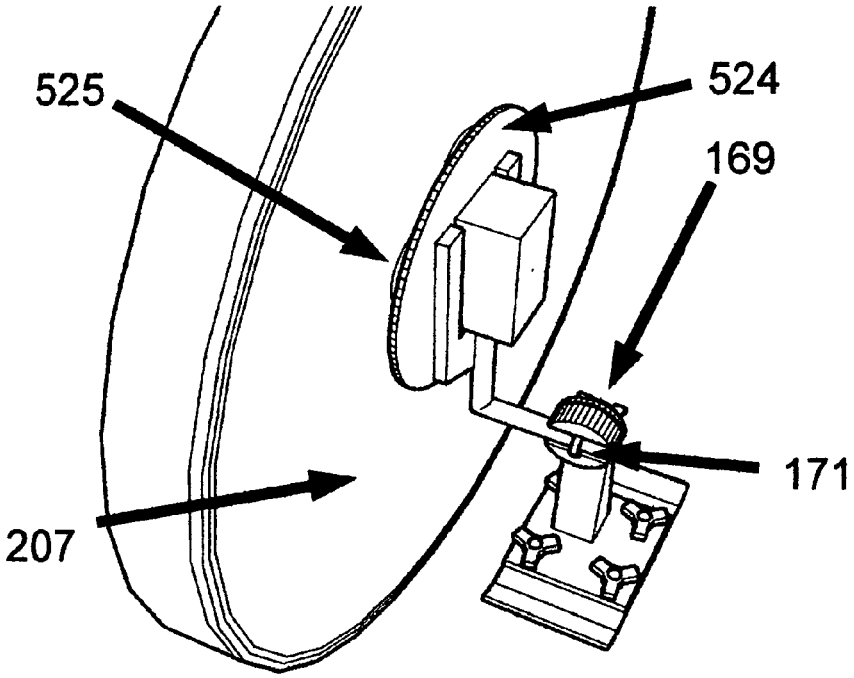

In FIG. 11D, the muffling pad 524 has been jammed into the head at the point of impact, completely flattening the cones 525. The drum has been completely muffled, and it will emit a quick crack when the head is struck by the pedal.

Most drummers throw a towel or pillow into their drums for muffling purposes, which makes it difficult to precisely adjust for head resonance. My device allows drummers to easily set the exact amount of desired muffling pressure and its location on the head, which remains locked in place until the drummer changes it with a very simple three dimensional adjustment device.

Figure 12:
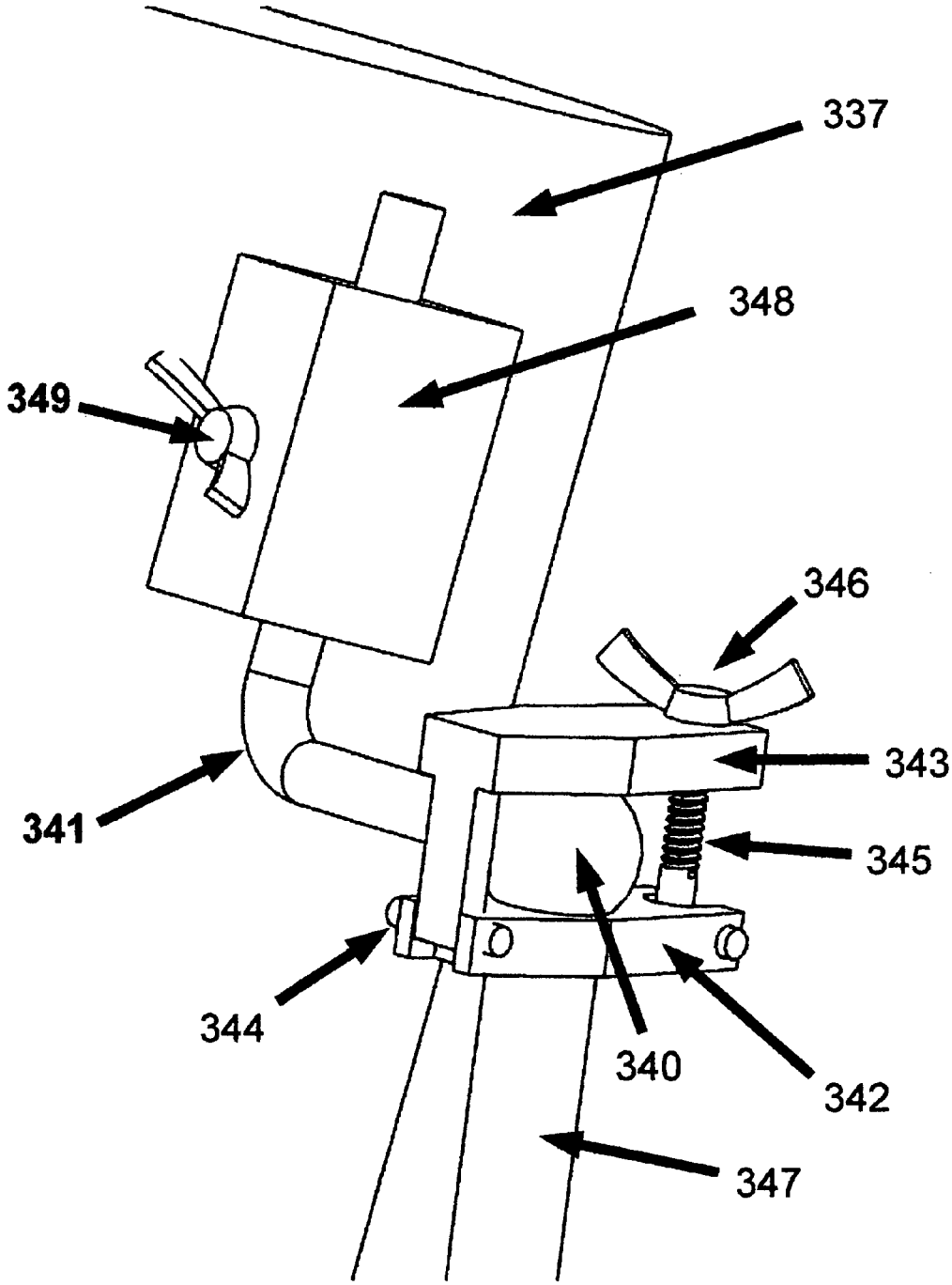
FIG. 12 depicts a prior art ball-arm clamping device used to hold a tom-tom.

A prior art method of mounting percussion instruments is shown in FIG. 12, and this device is typically used to mount tom-toms to bass drums. Note that the mounting arm 341 has one end which is a ball 340 that is held in an arm clamping device, which in this example is comprised of a base plate 342, a clamp lid 343 joined to the base plate using a hinge 344 on one end and a vice screw 345 and nut 346 on the other. The base plate 342 is attached to the support tube 347, which is typically inserted into a hole clamp on the top of a bass drum (not shown). The drum mounting device 348 is attached to the drum shell 337, and clamps to the arm 341 using a set nut 349. My universal mounting stand can also use the ball-and-arm mount, when several important modifications are made.

Figure 13:
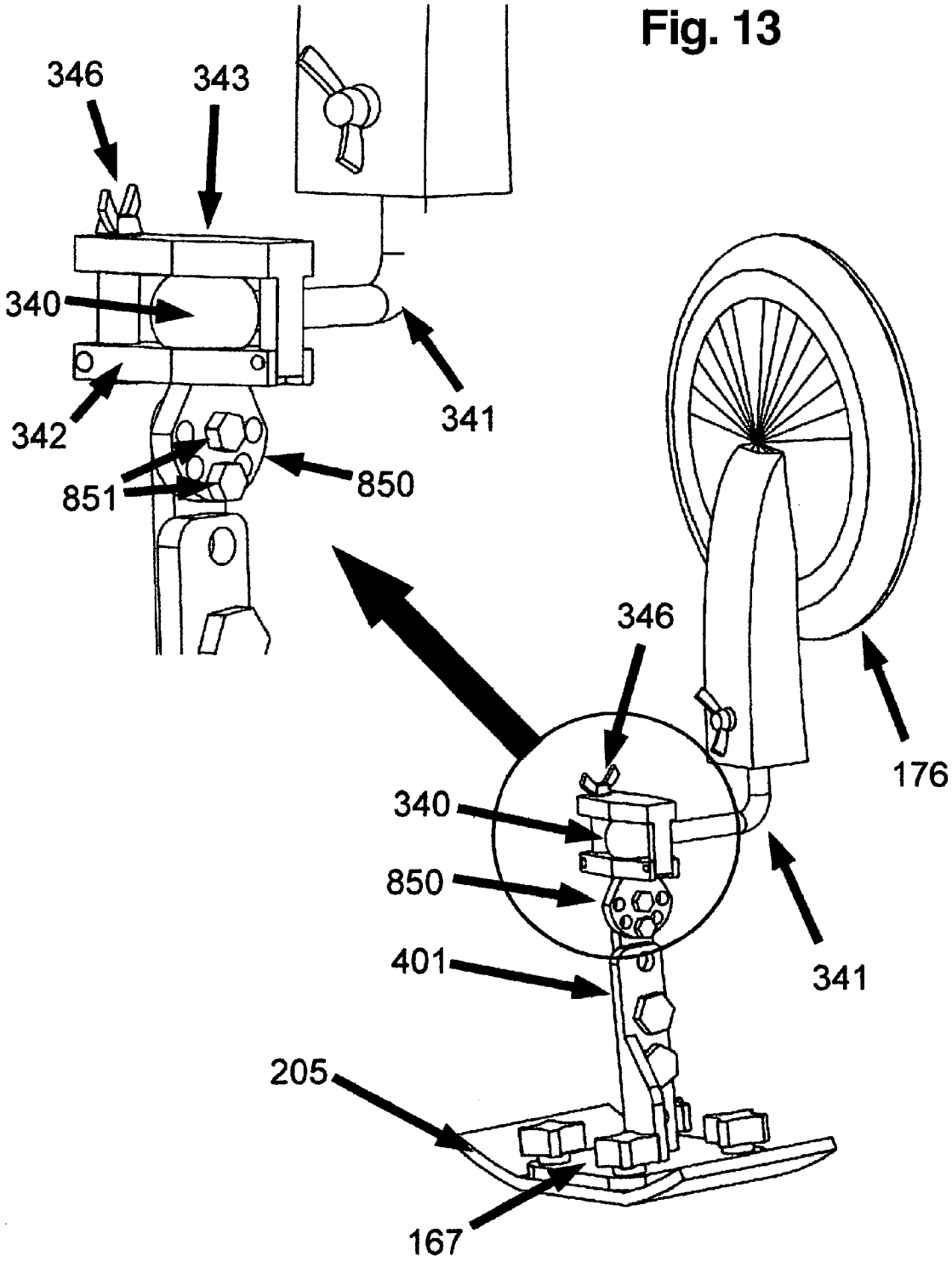
FIG. 13 depicts a modified ball-arm clamping device used in a universal mounting stand.

In FIG. 13, an embodiment of my invention makes use of a ball-and-arm (340,341) held in place by a clamping device (340, 342, 343 and 346) as in prior art. The clamping assembly has been mounted to a support bar 401 that is adjustable in height as previously described. But instead of permanently attaching the clamp base 342 to the upper portion of the stand body 401, the clamp base is attached to a tilting bracket 850 which has several mounting holes, thereby allowing the clamping device to adjustably tilt relative to the stand body. The tilting bracket 850 is bolted to the upper portion of the stand body 401 using adjustment bolts 851. Note that in this example, the drum pad 176 attaches to a mounting arm 341 that is essentially vertical, and that the clamp base 342 is horizontal as in prior art (FIG. 12).

Figure 14:
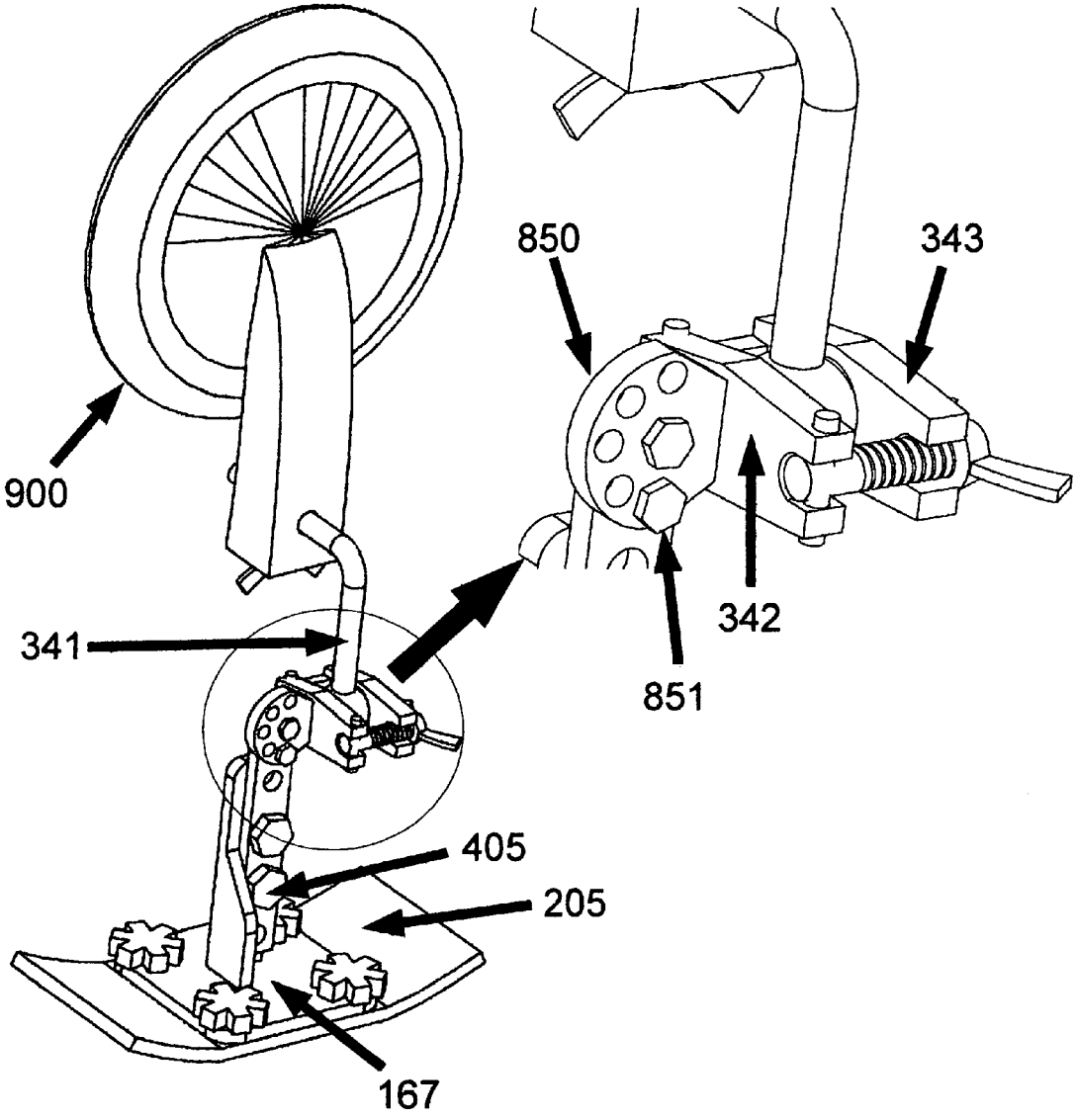
FIG. 14 depicts a modified ball-arm clamping device in the tilted position.

Unfortunately, there is a wide variety of mounting schemes used by percussion instrument manufacturers, and the vertical mounting arm (as presented in FIGS. 12 and 13) doesn't always work. FIG. 14 shows how my universal mounting stand can be adjusted to mount any device. Here are the changes that have been made to the mounting stand of FIG. 13 to accommodate a drum pad 900 that mounts to an arm that is essentially horizontal as depicted in FIG. 14:

1. The base plate 167 has been rotated 90 degrees and re-attached to the mounting platform 205.
2. The clamp base 342 has been tilted 90 degrees using the tilting bracket 850 and a repositioned adjustment bolt 851. Note that the entire clamp assembly is now laying on its side.
3. The ball-and-arm 341 has been rotated 90 degrees inside the clamp assembly (342, 343) and the mounting arm now lies horizontally.
4. The entire stand body has been shortened using repositioned stand body assembly bolts 405 as previously described.

The ability to make so many important adjustments is not possible with any prior art appliance.

As this invention may be embodied in several forms without departing from the spirit or essential characteristics thereof, the present embodiment is therefore illustrative and not restrictive, since the scope of the invention is defined by the appended claims rather than by the description preceding them, and all changes that fall within metes and bounds of the claims, or equivalents of such metes and bounds are therefore intended to be embraced by the claims.

I claim:

1. A percussion instrument mounting stand for holding a percussion instrument in a selected position comprising:
- a mounting platform;
- a stand base which may adjustably rotate on an axis perpendicular to the mounting platform;
- stand base attachment devices which secure the stand base to the mounting platform when the stand base has been rotated to the desired position;
- a stand body having a first end attached to said stand base and a second distal end;
- an arm clamping device connected to said stand body second distal end, said arm clamping device having an opening;
- a mounting arm having a first end that is held in place in said arm clamping device opening and a second end, wherein:
  - said mounting arm first end may adjustably rotate 360 degrees before being secured in place by the arm clamping device and;
  - said mounting arm second end fits into the mounting device of an electronic drum pad or other percussion instrument.

2. The percussion instrument mounting stand of claim 1 wherein:
- said mounting platform is selected from the group consisting of a bracket attached to the inside of a bass drum, the shell of a bass drum, a floor plate or the base of a drum pedal.

3. The percussion instrument mounting stand of claim 1 wherein:
- said stand body is selected from a group consisting of a bar, a tube, a length of angle iron, a set of telescoping tubes, or a set of brackets.

4. The percussion instrument mounting stand of claim 3 wherein:
- said telescoping tubes may be adjustable in height using one or more adjustment clamps.

5. The percussion instrument mounting stand of claim 3 wherein:
- The said set of brackets may have a plurality of holes that allow the drummer to adjust the height of the stand body.

6. The percussion instrument mounting stand of claim 1 wherein:
- the stand base attachment devices may be comprised of bolts and nuts or knobs that secure the stand base to the mounting platform.

7. The percussion instrument mounting stand of claim 1 wherein:
- said arm clamping device may be comprised of a rotating assembly or a ball clamp assembly.

8. The percussion instrument mounting stand of claim 7 wherein:
- said rotating assembly is comprised of:
  - a first portion attached to said second distal end of said stand body;
  - a second portion which has a cradle for said mounting arm and is pivotably disposed relative to said first portion;
  - an eye bolt which has an opening on a first end and screw threads on a second distal end, wherein said eye bolt:
    - accepts the first end of the mounting arm in said opening and forces all rotating assembly parts together and
    - forces the mounting arm into the cradle of the second portion and
    - prevents said arm from all movement when:
      - said second distal end is inserted through the second portion of the rotating assembly and the first portion of the rotating assembly, and a nut or knob is tightened on said screw threads.

9. The percussion instrument mounting stand of claim 7 wherein:
- said ball clamp assembly may be comprised of a base plate, a hinge, a top plate, and a clamping bolt, thereby forming an opening for the mounting arm.

10. The percussion instrument mounting stand of claim 1 wherein:
- said first end of said mounting arm may be a ball that is held in a ball clamp assembly.

11. The percussion instrument mounting stand of claim 7 wherein:
- said ball clamp assembly may be mounted on a tilting bracket, allowing the entire ball clamp assembly to adjustably tilt relative to the stand body.

12. The percussion instrument mounting stand of claim 2 wherein:
- said floor plate may include a mounting dock for a bass drum pedal.

13. The percussion instrument mounting stand of claim 1 wherein:
- said stand base may include several symmetrical mounting holes that allow the drummer to rotate the entire stand along the longitudinal axis of the stand body, and attach said stand base to said mounting platform as desired.

14. The percussion instrument mounting stand of claim 1 wherein:
- said mounting arm may be bent at a 90 degree angle.

15. The percussion instrument mounting stand of claim 1 wherein:
- said mounting arm first end may differ in diameter from said mounting arm second end.

16. The percussion instrument mounting stand of claim 1 wherein:
- said other percussion instrument attached to the mounting arm may be a muffling pad.

17. The percussion instrument mounting stand of claim 16 wherein:
- said muffling pad may be comprised of one or more cones.

18. A percussion instrument mounting stand for holding a percussion instrument in a selected position comprising:

a mounting platform;

a stand body comprised of a lower tube part attached to said mounting platform and an upper tube part, said lower and upper tube parts telescoping into each other;

a tube clamping device which secures the upper and lower tube parts together;

an arm clamping device connected to said upper tube part, said arm clamping device having an opening;

a mounting arm having a first end that is held in place in said arm clamping device opening and a second distal end, wherein:

said mounting arm first end may adjustably rotate 360 degrees before being secured in place by said arm clamping device and;

said mounting arm second end fits into the mounting device of an electronic drum pad or other percussion instrument.

19. The percussion instrument mounting stand of claim 18 wherein:

said mounting platform is selected from the group consisting of a bracket attached to the inside of a bass drum, the shell of a bass drum, a floor plate or the base of a drum pedal.

20. The percussion instrument mounting stand of claim 18 wherein:

the telescoping tube parts may be adjustable in height using one or more adjustment clamps.

21. The percussion instrument mounting stand of claim 18 wherein:

the upper tube part is rotatable along its longitudinal axis in relation to the lower tube part until said adjustment clamp is tightened, thereby holding the upper and lower tube parts together.

22. The percussion instrument mounting stand of claim 18 wherein:

said arm clamping device may be comprised of a rotating assembly or a ball clamp assembly.

23. The percussion instrument mounting stand of claim 22 wherein:

said rotating assembly is comprised of:

a first portion attached to an upper distal end of said stand body;

a second portion which has a cradle for said mounting arm and is pivotably disposed relative to said first portion;

an eye bolt which has an opening on a first end and screw threads on a second distal end, wherein said eye bolt:

accepts the first end of the mounting arm in said opening and forces all rotating assembly parts together and forces the mounting arm into the cradle of the second portion and prevents said arm from all movement when:

the screw thread end is inserted through the second portion of the rotating assembly and the first portion of the rotating assembly, and a nut or knob is tightened on said screw threads.

24. The percussion instrument mounting stand of claim 22 wherein:

said ball clamp assembly may be comprised of a base plate, a hinge, a top plate, and a clamping bolt, thereby forming an opening for the mounting arm.

25. The percussion instrument mounting stand of claim 18 wherein:

said first end of said mounting arm may be a ball that is held in the ball clamp assembly.

26. The percussion instrument mounting stand of claim 18 wherein:

said floor plate may include a mounting dock for a bass drum pedal.

27. The percussion instrument mounting stand of claim 22 wherein:

said ball clamp assembly may be mounted on a tilting bracket, allowing the entire ball clamp assembly to adjustably tilt relative to the stand body.

28. The percussion instrument mounting stand of claim 18 wherein:

said mounting arm first end may differ in diameter from said mounting arm second end.

29. The percussion instrument mounting stand of claim 18 wherein:

said mounting arm may be bent at a 90 degree angle.

30. The percussion instrument mounting stand of claim 18 wherein:

the said other percussion instrument attached to the mounting arm may be a muffling pad.

31. The percussion instrument mounting stand of claim 18 wherein:

the muffling pad may be comprised of one or more cones.

* * * * *